United States Patent [19]

Schneider et al.

[11] Patent Number: 4,497,269

[45] Date of Patent: Feb. 5, 1985

[54] METHOD OF MAKING AESTHETIC QUILTING

[76] Inventors: Charles Schneider; Bruce H. Schneider; Jerry S. Schneider, all of 518 N. 10th St., Council Bluffs, Iowa 51501

[21] Appl. No.: 488,043

[22] Filed: Apr. 25, 1983

Related U.S. Application Data

[63] Continuation-in-part of Ser. No. 383,593, Jun. 1, 1982, abandoned.

[51] Int. Cl.[3] ..... D05B 57/00; D05B 21/00; D05B 11/00; D05C 17/00

[52] U.S. Cl. ..... 112/262.3; 112/121.15; 112/119; 112/439; 112/440; 112/103

[58] Field of Search ..... 112/266.1, 262.3, 121.11, 112/121.12, 121.15, 102, 103, 118, 119, 439, 440, 441, 420, 65

[56] References Cited

U.S. PATENT DOCUMENTS

| | | | |
|---|---|---|---|
| 3,001,489 | 9/1961 | Bond et al. | 112/121.12 |
| 3,044,426 | 7/1962 | Schwarzberger | 112/117 |
| 3,164,112 | 1/1965 | Bono | 112/121.12 |
| 3,208,414 | 9/1965 | Reeber et al. | 112/102 X |
| 3,323,476 | 6/1967 | Kass | 112/65 |
| 3,329,109 | 7/1967 | Portnoff et al. | 112/102 X |
| 3,349,732 | 10/1967 | Perrella et al. | 112/65 |
| 3,450,076 | 6/1969 | Bender | 112/121.12 X |
| 3,497,780 | 2/1970 | Leenhouts | 112/121.12 X |
| 3,934,776 | 1/1976 | Cruden, Jr. | 112/65 X |
| 4,192,241 | 3/1980 | Reed et al. | 112/117 |

*Primary Examiner*—H. Hampton Hunter
*Attorney, Agent, or Firm*—George R. Nimmer

[57] ABSTRACT

Method and apparatus for making aesthetically pleasing and novel quilting including intricate artistic stitching-patterns. The quilting results from a preferably tri-laminar layup having a resiliently-compressible foam layer sandwiched between relatively thin facing and base fabric sheets. The method utilizes a tabletop for supporting the layup, at least one sewing machine head overlying and associated with the tabletop, and gripper means for frictionally engaging non-peripheral areas of the layup for shifting same along the tabletop relative to the sewing head according to successive command means. Utilizing a primary sewing-command means for the gripper, a primary-design portion of the overall stitching-pattern is made within a primary-area of the layup; then, utilizing a reposition-command means, the gripper shifts the layup so as to bring a layup secondary-area toward the sewing head; and next, utilizing a secondary sewing-command means for the gripper, another portion of the overall stitching-pattern is made outside the layup primary-area.

13 Claims, 7 Drawing Figures

METHOD OF MAKING AESTHETIC QUILTING

This application is a continuation-in-part of copending application Serial No. 383,593 (filed June 1, 1982) and now abandoned.

As alluded to in drawing FIGS. 1 and 2, a typical quilting 100Q (FIG. 2) is generally defined to mean a relatively thick sheet (102) of foam or other resiliently-compressible material sandwiched between relatively thin facing (101) and base (103) fabric sheets sewn together with stitches (104) that collectively define stitchlines forming an overall stitching-pattern viewable at surfaces 101A and 103A of the facing and base sheets as valley-like depressions 101D and 103D, respectively. Method steps for making quilting 100Q commence from a trilaminar layup 100 (FIG. 1) of the three sheets 101–103 which are then sewn together with a plurality of foam-pinching and hence depressed (101D, 103D) stitches 104. Because of the deep depression (101D, 103D) resulting at each stitch 104, the imposition of each stitch 104 into layup 100 causes the facing (101) and base (103) sheets to creep along the two surfaces of the foam layer 102, which creep is also manifested at offsets 101E and 103E in FIG. 2.

The quilting art has long recognized that stitching-induced creeping of the facing (101) and base (103) sheets should not be interferred with lest unsightly distorted compactions result at layers 101 and 103 between the stitchlines of the overall stitching-pattern. For tediously controlled hand sewing quilting techniques of the early prior art, there is no problem in permitting the facing and base sheets to creep. However, for economic reasons, the recent prior art has aspired to replace hand sewn quilting with mass-production techniques utilizing sewing machines (e.g. 90) to convert the layup 100 into quilting 100Q, such also commonly requiring mechanical shifting of the layup 100 along some underlying support (e.g, tabletop 10). There are at least two such mass-production techniques, both of which have serious limitations in their ability to not interfere with stitching-induced creeping of the facing and base sheets. One such mass-production technique is the so-called "jig technique" as taught in U.S. Pat. No. 3,044,426 wherein the trilaminar layup (100) is tightly peripherally clamped in a jig-like framework that is shiftable in both horizontal directions. Though the "jig technique" does have the capability of imparting unlimited design arrays of stitchlines whereby the overall stitching-pattern might have artistry satisfying epicurean tastes, the tight peripheral clamping by the jig-like framework does not permit creep. Accordngly, such creep intereference by the peripheral jig results in quilting that suffers from distorted compactions at the facing and base sheets between the stitchlines forming the stitching-pattern, thereby detracting from the quilting aesthetic appeal. In response to the creep interference problem of the "jig technique", more recent prior art (as exemplified by U.S. Pat. No. 4,192,241) has developed the "roll-letoff technique" which is basically a trade-off that permits creep to occur in one of the two horizontal directions but at the cost of limiting stitching-patterns to low-amplitude undulations. Accordingly, the necessarily rudimentary stitching-patterns of the "roll-letoff technique" does not have the artistry to satisfy epicurean tastes.

It is accordingly the general objective of the present invention to provide improved quilting methods utilizing at least one stationarily positioned sewing machine and also utilizng non-peripheral gripper means that permits creep of the layup facing and base sheets. It is a related general objective to provide method and apparatus for making quilting utilizing an improved layup shifting technique whereby intricate artistic stitching-patterns might be formed with a commercial sewing machine but wherein the quilting stitching-pattern has the appearance of hand sewn quilting, with special attributes including consistent stitch lengths, absence of distorted compactions between stitchlines of the stitching-pattern, and having other necessary attributes contributing to high quality and artistic aesthetic appeal. Another related general objective is to provide quilting methods and ancillary apparatus amenable to the mass-production of high quality aesthetic quilting at relatively low cost.

With the above and other objects and advantages in view, which will become more apparent as this description proceeds, the quilting method of the present invention generally comprises the employment of a gripper means that overlies and is multi-directionally movably associated with a sewinig machine head and a stationary tabletop support for the resiliently compressible laminar layup, said gripper means employment being successively: during an earlytime-period, shifting the layup in both horizontal directions according to a primary sewing-command means whereby the sewing machine needle provides exclusively within a primary-area of the layup a primary-design portion of the quilting predetermined stitching-pattern; then, after said earlytime-period and before a latertime-period, moving the gripper means upwardly, horizontally, downwardly, and finally horizontally to shift the layup primary-area away from the sewing needle; and during said latertime-period, shifting the layup in both horizontal directions according to a secondary sewing-command means whereby the sewing needle provides outside the primary-area a secondary-design portion of the quilting overall stitching-pattern.

In the drawing, wherein like characters refer to like parts in the several views, and in which.

Figure 3:
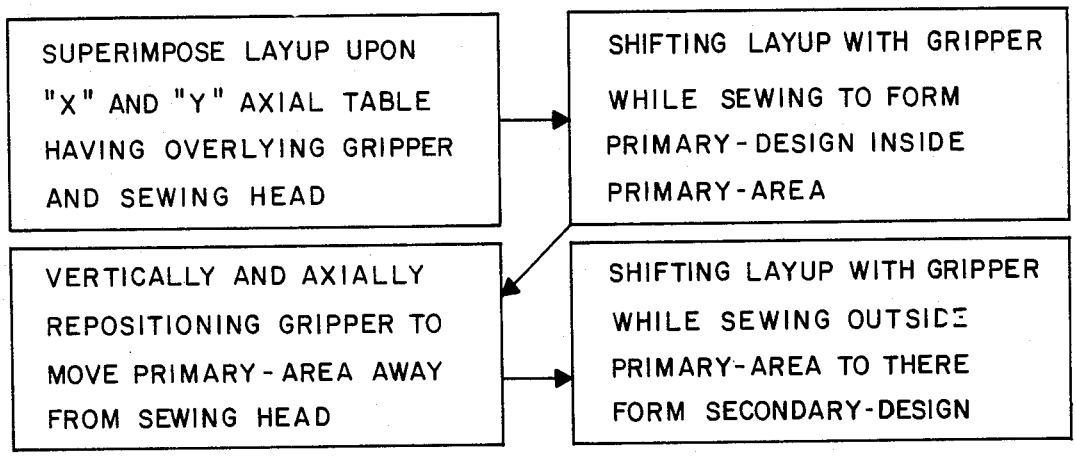
FIG. 3 is a schematic flow diagram indicating the general steps for making quiliting according to the improved method of the present invention.
Figure 4A:
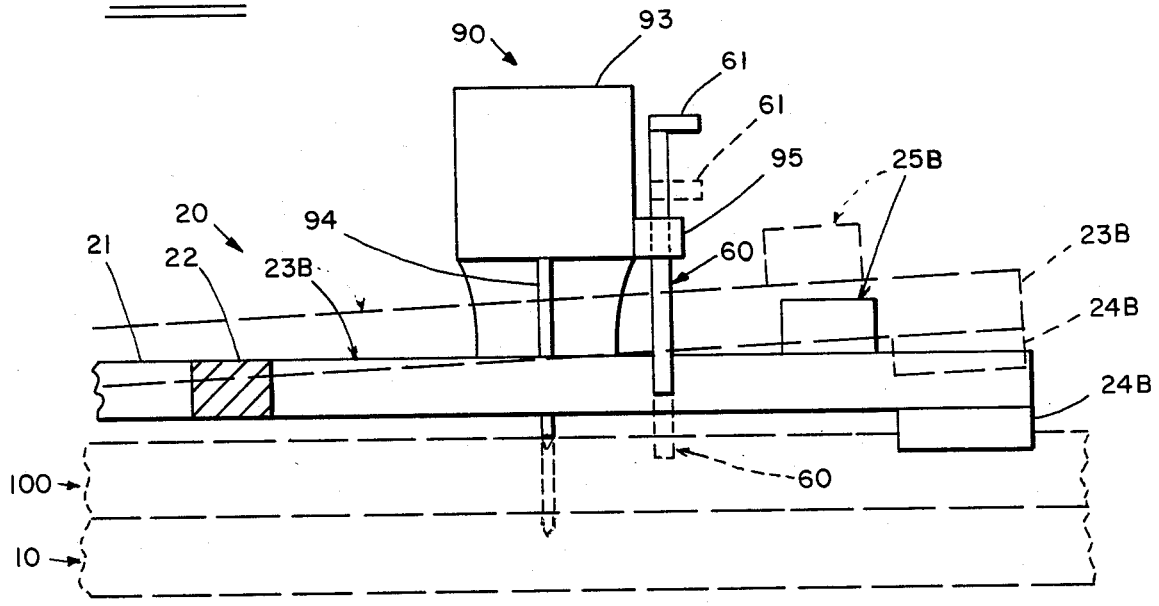
FIG. 4A is a sectional elevational view taken along lines 4A—4A of FIG. 4 and depicting an optionally employable steadying means.
Figure 4:
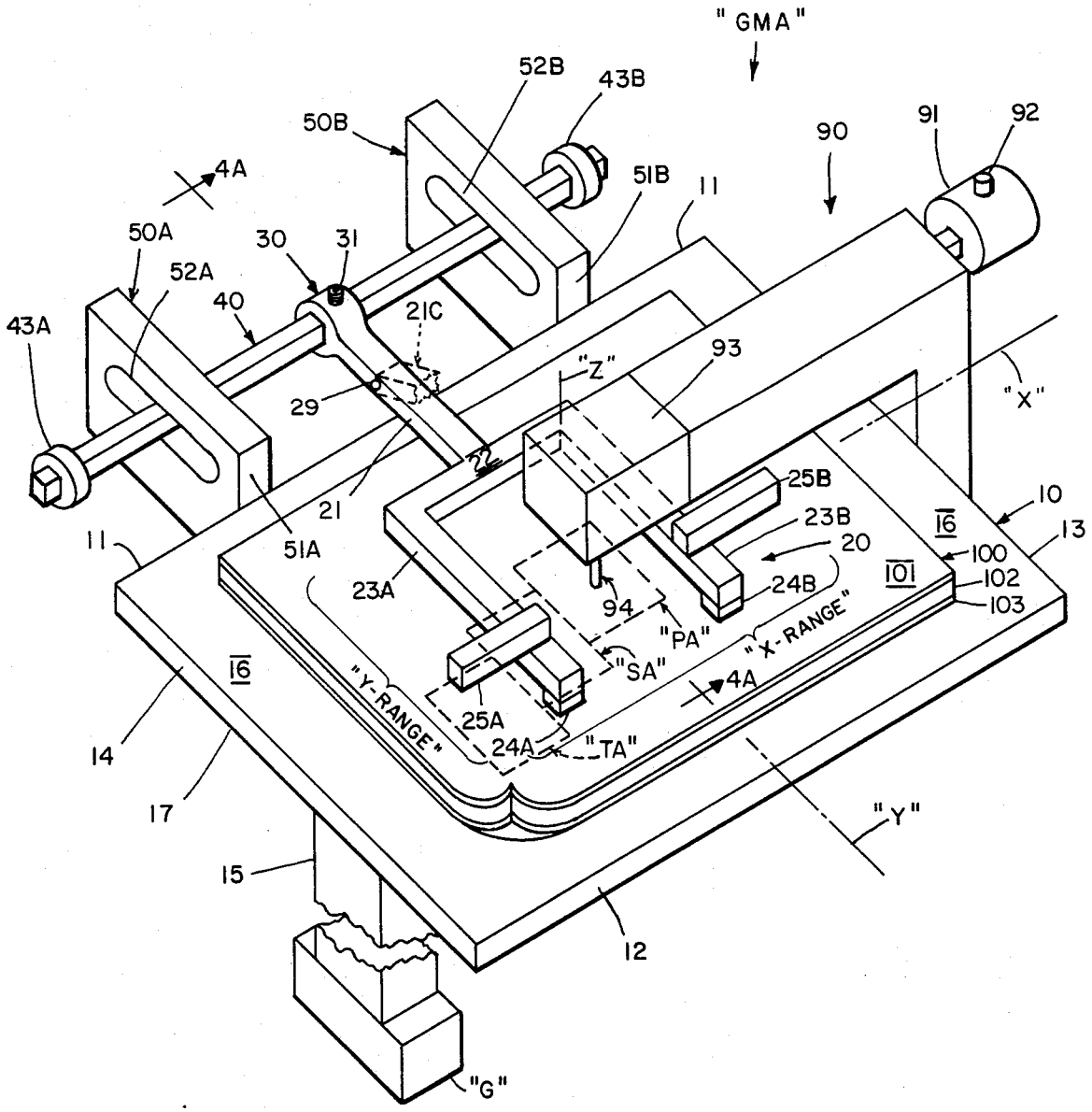
FIG. 4 is a perspective view of a rudimentary apparatus (including tabletop, commercial sewing machine, and gripper means) for implementing the method schematically depicted in FIG. 3.

The general method for making quilting having some predetermined stitching-pattern, and schematically indicated in the FIG. 3 flow diagram, might be practiced with the rudimentary apparatus "GMA" of FIG. 4. Rudimentary apparatus "GMA" comprises a generally horizontal tabletop 10 supported loftily above an underlying substrate "G" by upright leg means 15 depending from tabletop underside 17. The horizontal uppersurface 16 of tabletop 10 is defined by mutually perpendicular horizontal imaginary axes "x" and "y". The tabletop might take the rectangular shape shown including a pair of "x"-laterally extending borders 11 and 12, and a pair of "y"-longitudinally extending borders 13 and 14. Removably superimposed upon uppersurface 16 is a flexible trilaminar layup 100 to be sewn into quilting, the low est portion (e.g. 103) lying directly upon uppersurface 16. Attached to tabletop 10 and loftily overlying uppersurface 16 and layup 100 is a conventional sewing machine 90 having electric motor 91 (having "on-off" switch 92) and including sewing needle 94 vertically reciprocatable along axis "z", said needle 94 depending from sewing machine head 93. For layups (e.g. 100) of relatively small plan area, the entire selectable stitching-pattern might be accomplished with a stationarily positioned sewing machine. In such cases, tabletop 10 might inlcude a bobbin cooperating with the "z"-vertically reciprocatable needle 94 of a stationary (i.e. fixed position) sewing head 93.

Overlying tabletop uppersurface 16 and layup 100 is a gripper means 20 that is independently movable: in both vertical directions "z" between up-station and down-station; in both lateral directions "x"; and in both longitudinal directions "y". As will be pointed out, the gripper means at down-station is adapted to compress and frictionally engage the layup (100) so as to shift same horizontally in the "x"-lateral and the "y"-longitudinal directions relative to sewing needle 94. Herein, gripper means 20 takes a bifurcate form comprising a pair of longitudinally extending parallel arms 23A and 23B which are laterally spaced apart by a connector-bar 22. Arms 23A and 23B are respectively equipped with depending frontal pads 24A and 24B for frictionally engaging layup facing sheet 101, and are further respectively equipped with laterally extending topical handles 25A and 25B. Rearwardly longitudinally extending from horizontal connector-bar 22 is a dog 21 that is attached by horizontal pivot-pin 29 to a longitudinal extension 30 of a carriage means (e.g. 40, 50A, 50B), whereby as indicated by phantom line 21C, the gripper means 20 at the up-station is upwardly away from tabled layup 100. Extension 30 is attached (as by set-screw 31) to a fixed central location of horizontal elongate-bar 40 lying parallel to the "x" axis and having a rectangular cross-sectional shape; the two ends of elongate-bar 40 carry enlarged rims 43A and 43B set away from slotted-bars 50A and 50B. The laterally separated and horizontal slotted-bars 50A and 50B, which are parallel to the ∓y" axis, have their fore-ends 51A and 51B rigidly attached to tabletop rear peripheral border 11. Elongate-bar 40 is longitudinally reciprocatably associated within equal-length longitudinal slots 52A and 52B of bars 50A and 50B, respectively; moreover, elongate-bar 40 is laterally reciprocatably movable through the slots 52A and 52B. Thus, the gripper means 20 above tabletop 10 has a "y-range" of travel (determined by the longitudinal length of slots 52A and 52B) and has an "x-range" of travel (determined by the total flanking distances of rims 43A and 43B from bars 50A and 50B).

In utilizing rudimentary apparatus "GMA" to practice the general quilting method schematically depicted in FIG. 3, the operator performs the following procedural maneuvers. First, and while switch 92 is turned "off", the operator lifts a handle 25 to permit insertion of layup 100 between the gripper means up-station and the tabletop uppersurface 16. Then, handle 25 is depressed, so that the gripper means at down-station compresses layup 100 with pads 24 making frictional contact with layup facing sheet 101. Next, and while switch 92 is turned "on", the operator areally restricts his attention to a relatively small rectangular primary-area "PA" of layup surface 101A, which primary-area "PA" in dimensions is laterally less than the "y?-range"and is longitudinally less than the "y-range". While thus areally restricting his attention, and through manipulation of handles 25, the operator shifts layup 100 along tabletop 10 according to a plan of his mental choosing (i.e. a primary sewing-command means), thereby resulting in a stitched primary-design portion within primary-area "PA". Next, and while switch 92 is at least initially turned "off", the operator plans the following reposition-command means sub-steps and executes same, as through handles 25:

(a) moving the gripper means to up-station, upwardly away from layup 100, (This sub-step permits the facing 101 and the base 103 sheets to creep (except in primary-area "PA")), (b) horizontally translating the gripper means to a new position, (c) at gripper means down-station, re-compressing layup 100 (including frictional engagement by pads 24 with facing sheet 101) at said new position, and (d) shifting primary-area "PA" remotely away from sewing needle 94. (At this time, or immediately thereafter, switch 92 is turned "on"), Next, and while switch 92 is "on", the operator areally restricts his attention to outside primary-area "PA", such as within an analogously defined secondary-area "SA". While thus areally restricting his attention, and through manipulation of handles 25, the operator shifts layup 100 along tabletop 10 according to his plan (i.e. a primary or a secondary sewing-command means), thereby resulting in a stitched design portion outside primary-area "PA" which might be the secondary-design portion inside secondary-area "SA". This last made secondary-design portion in area "SA", coupled with the earlytime-period primary-design portion in area "PA", provides a quilting product e.g. 100QM, having an overall predetermined stitching-pattern. If the operator so chooses, he might again successively repeat the reposition-command means and the further selectable sewing-command means in a layup tertiary-area ("TA"), etc.

To ensure that the layup 100 does not shift along the tabletop 10 during the reposition-command means sub-steps, a steadying means (60) is downwardly engageable against compressible layup 100, though upwardly withdrawn therefrom when sewing-command means are being employed. As indicated in FIG. 4A, a rudimentary steadying means might take the form of a rod 60 (having upper knob 61) vertically reciprocatably associated within a stationary collar 95 of stationary sewing head 93. Solid line in FIG. 4A indicates the steadying means 60 during employment of sewing-command means, and phantom line indicates the steadying means employment during utilization of reposition-command means.

Figure 5:
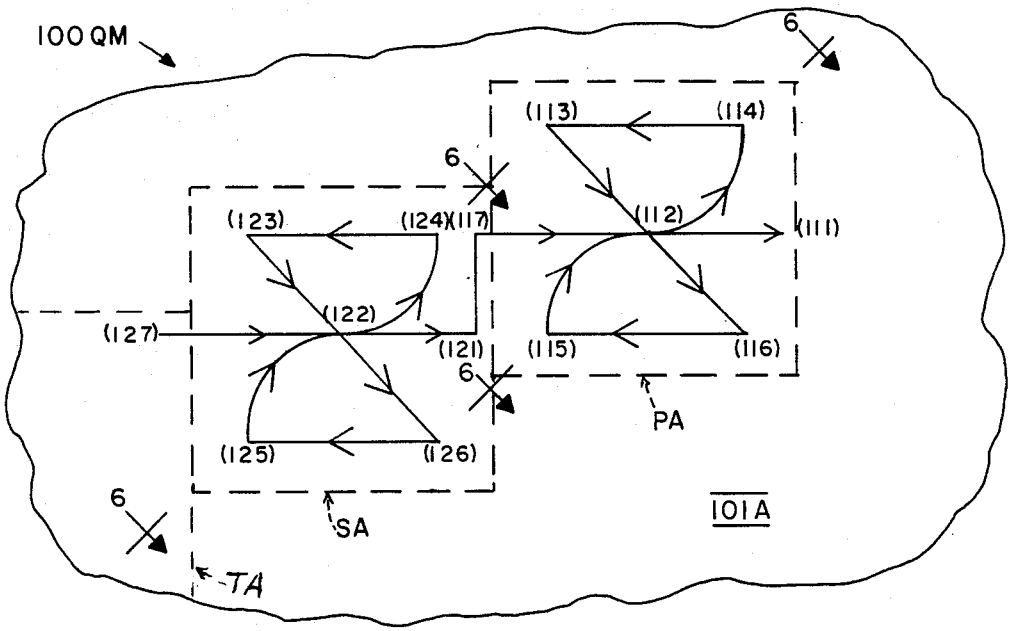
FIG. 5 is a top plan view of quilting having a representative stitching-pattern that might result for the novel method of the present invention.

Shown in FIG. 5 is a top plan view of typical quilting 100QM made in accordance with the method schematically depicted in FIG. 3, such as with the rudimentary apparatus of FIG. 4. The representative stitching-pattern for quilting embodiment 100QM comprises two stitchline-connected "skewed-8" shapes in the primary-area "PA" and in the secondary-area "SA". Arrows along the stitching-pattern indicate shifting of layup 100 relative the stationarily positioned sewing head (93) (94), said shifting along the tabletop (10) being caused by gripper means (20) according to sewing-command means. To make the stitching-pattern depicted in FIG. 5, the following procedure is followed:

(a) the operator turns switch 92 "on", whereby sewing needle 94 commences to impart stitches 104 commencing at site 111. Immediately, the operator grasps and presses downwardly upon handles 25 whereby the gripper means assumes down-station wherein pads 24 compress and frictionally engage layup 100 in flanking relationship to primary-area "PA". Then, the operator through sewing-command means aspires to attain the primary-design portion in area "PA" by moving handles 25 in the following seven-directions:

firstly, linearly rightwardly (laterally) to have the stitchline reach 112, secondly, linearly forwardly-rightwardly (longitudinally and laterally) to have the stitchline reach corner cusp 113, thirdly, linearly leftwardly (laterally) to have the stitchline reach cusp 114, fourthly, curvedly rearwardly-leftwardly (longitudinally and laterally) to have the stitchline reach cusp 115 via 112, fifthly, linearly leftwardly (laterally) to have the stitchline reach cusp 116, sixthly, linearly forwardly-rightwardly (longitudinally and laterally) to have the stitchline again reach 112, and seventhly, linearly rightwardly (laterally) to have the stitchline reach cusp 117 at the border of primary-area "PA". Immediately following the seventh direction, the operator turns switch 92 "off";

(b) with handle 25, the operator lifts gripper means 20 to the up-station and upwardly away from layup 100, whereby creep automatically occurs outside primary-area "PA". Then, the operator moves the up-station gripper means horizontally in the laterally leftwardly and longitudinally forwardly directions, and then the operator presses downwardly whereby the down-station pads 24 again compress and frictionally engage layup 100 (but in flanking relationship to secondary-area "SA"). The operator turns switch 92 "on", whereby sewing needle 94 commences to again impart stitches 104 into layup 100 commencing at site 117, and moves the gripper means linearly longitudinally rearwardly to have the stitchline reach site 121; and (c) the operator re-performs the seven-directions specified in the second preceeding paragraph (a) whereby the stitchline reaches points 122, 123, 124, 122, 125, 126, 122, and 127, in order.

Figure 6:
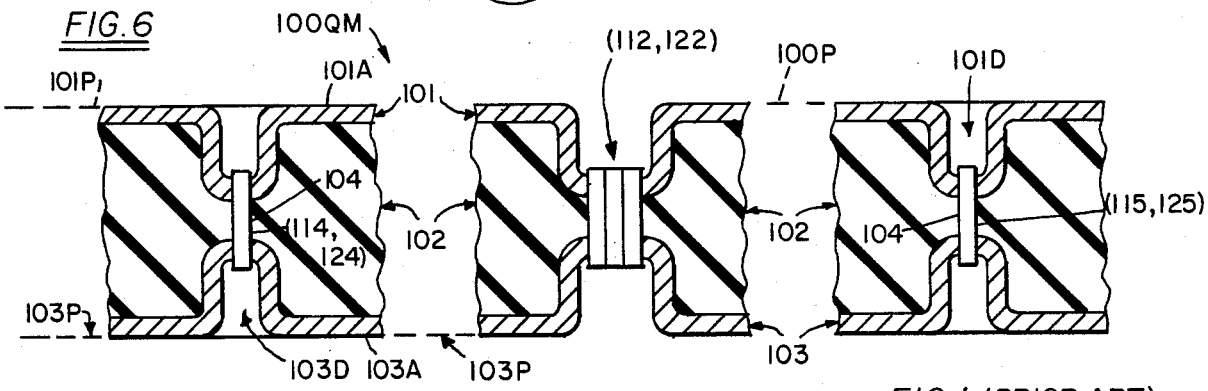
FIG. 6 is a sectional elevational view, similar to FIG. 2, and taken along lines 6—6 of FIG. 5.
Figure 1:
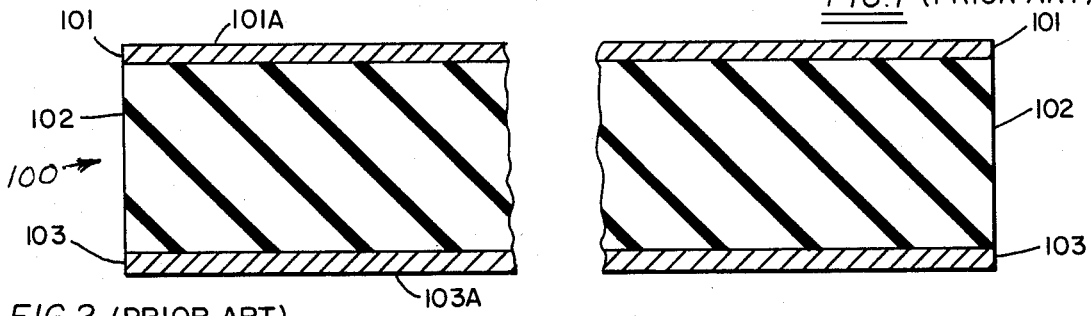
FIG. 1 (PRIOR ART)
FIG. 1 is a sectional elevational view of a trilaminar type layup preliminary method step for making quilting, both in the prior art and for the novel quilting method of the present invention.
Figure 2:
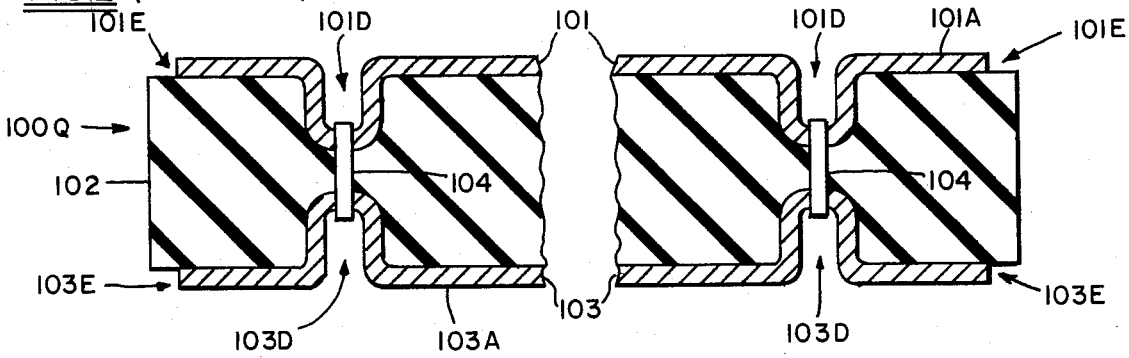
FIG. 2 (PRIOR ART)
FIG. 2 is a sectional elevation view of typical prior art quilting resulting from stitching the FIG. 1 layup, and especially true in hand sewing.

FIG. 6 shows for quilting 100QM (resulting from the method) that at points 112 and 122 there are three stitches (104) and that at points 114, 115, 124, and 125 there is a single stitch 104. FIG. 6 also shows that from the quilting method, base sheet 103 extends generally along a base-plane 103P except that the actual stitching-pattern 103D extends thereabove, and facing sheet 101 extends generally along facing-plane 101P except that the actual stitching-pattern 101D extends therebelow. The vertical height of quilting 100QM between planes is substantially equal to that of the original layup 100. In a related vein, there are not distorted compactions of this uniform vertical height 101P–103P between the depressed (101D, 103D) stitching-pattern, which results from the prior art "jig technique". The artistic stitching-pattern seen in FIG. 5 is not possible from the prior art "roll-letoff technique". Quilting 100QM contrasts with hand sewing techniques of the early prior art in that facing sheet 101 and base sheet 103 are devoid of inscribed markings corresponding to the stitching-pattern, and in that the length of each stitch 104 along the entire stitching-pattern is constant (including at the stitching-pattern cusps). In the latter vein, the constant stitch lengths might be imparted with well known prior art teachings, such as taught in U.S. Pat. Nos. 3,329,109 and 3,450,076.

Apparatus adapted to practice the method of the present invention might be readily modified into alternate embodiments more sophisticated than shown in drawing FIGS. 4 and 4A. Representative, though non-limiting, alternative embodiments might include one or more of the following. Sewing-command and reposition-command means might be as apparatus associated computer programs such as taught in U.S. Pat. Nos. 3,208,414, 3,497,780, etc. The carriage means might be in forms as taught in U.S. Pat. Nos. 3,001,489, 3,164,112, 3,450,076, 4,273,059, etc. When a steadying means is employed, the respective padcarrying arms of the gripper means might move independently so as to permit corrective maneuvers for the layup regarding the "x" and "y" axes. These and other permitted design changes are left to the selection of those having ordinary skill in the art.

From the foregoing, the quilting method, the quilting resulting from the method, and the necessary apparatus, will be readily understood, and further explanation is believed to be unnecessary. However, since numerous modifications and changes will readily occur to those skilled in the art, it is not desired to limit the invention to the exact modes shown and described, and accordingly, all further modifications and changes might be resorted to, falling within the scope of the appended claims.

What is claimed is as follows:

1. Method for making quilting having a predetermined stitching-pattern including at least one cusp therealong and having an overall-area located both within and outside a rectangular primary-area having an x-lateral dimension and a y-longitudinal dimension, said method comprising the following steps:

(A) as the initial step, superimposing upon a horizontal tabletop a trilaminar layup of vertically aligned broad sheets including relatively thin facing and base fabric sheets sandwiching a relatively thick resiliently-compressible foam sheet, said tabletop extending laterally along an x-axis and extending longitudinally along a y-axis perpendicularly intersecting said x-axis, there being attached to and overlying said tabletop an interruptably operational sewing head including a vertically reciprocatable needle; and (B) continuously employing a gripper means that is movably associated with said tabletop and movable independently in the vertical, for an x-range parallel to the x-axis, and for a y-range parallel to the y-axis, and according to the following steps:

(Ba) during a chronologically early-time-period, downwardly compressing the trilaminar layup with said gripper means in flanking relationship to said primary-area and said sewing needle, and by said gripper means shifting the layup along the x-axis less than said x-range and along the y-axis less than said y-range through primary sewing-command means while continuously operating said sewing head whereby the sewing needle provides exclusively within said primary-area a primary-design portion of the predetermined stitching-pattern;

(Bb) after said earlytime-period and before a chronologically latertime-period, and through gripper reposition-command means performing the following sub-steps in order:

(i) moving the gripper means upwardly away from the layup, whereby the facing and base sheets are permitted to creep along the foam sheet toward the layup primary-area, (ii) translating the gripper means in at least one of the x-lateral and y-longitudinal directions, (iii) moving the gripper means downwardly so as to recompress the layup in a new position, this and the two preceeding sub-steps being performed while the sewing head is maintained in nonoperating condition, and (iv) utilizing said gripper means, shifting the layup primary-area remotely away from the sewing needle;

(Bc) during a chronologically latertime-period, maintaining said layup in re-compression in said new position and flanking the sewing needle, and by said gripper means shifting the layup along the tabletop along the x-axis less than said x-range and along the y-axis less than said y-range through secondary sewing-command means while said sewing head is operating whereby the sewing needle provides exclusively outside the primary-area another portion of the predetermined stitching-pattern; at least one of said sewing-command means providing non-linear stitchlines terminating at a cusp, some of the stitchlines intersecting remotely from a stitching-pattern cusp.

2. The method of claim 1 wherein during the gripper means translating sub-step, the translation is in both x-lateral and y-longitudinal directions; and wherein the final sub-step is accompanied by resumption of sewing head operation.

3. The method of claim 1 wherein between said earlytime-period and said latertime-period and during the gripper means translating sub-step, a steadying means initiated remote from said gripper means is downwardly engaged against the layup whereby the layup is maintained stationary, said steadying means being upwardly withdrawn from the layup whenever the sewing head is being operated whereby the layup is free to shiftably respond to the sewing-command means.

4. The method of claim 2 wherein there is continuous employment of gripper means comprising a pair of laterally spaced gripper pads for contacting the layup; and wherein the lateral dimension of said rectangular primary-area is less than the lateral spacing between said gripper pads.

5. The method of claim 4 wherein the sewing head is stationarily attached to and overlies the tabletop; and wherein the tabletop y-axis intersects the vertically reciprocatable needle of said stationary sewing head.

6. The quilting product manufactured by the processing method of claim 1 whereby said quilting product is characterized as follows:

(A) stitches forming the stitching-pattern cause compression of the foam sheet, each sewn stitch being of substantially the same length including throughout a cusped stitchline;

(B) the quilting base sheet extends generally along a base-plane, except along the stitching-pattern which extends above the base-plane;

(C) the quilting facing sheet extends generally along a face-plane, except along the stitching-pattern which extends as a depression below the face-plane;

(D) the vertical height of the quilting between the face-plane and the base-plane is substantially constant including also throughout the primary-area and the secondary-area except at said stitchline depressions corresponding to the primary-design and secondary-design portions; and (E) the underlying base sheet is wholly devoid of markings corresponding to the stitching-pattern except for the stitchlines actually forming the stitching-pattern.

7. The product of claim 6 wherein the number of stitches per lineal inch is constant and being within the selectable range of five to twenty stitches per lineal inch.

8. Apparatus for quilting a resilently compressible trilaminar layup of vertically aligned flexible sheets according to a predetermined stitching-pattern, said apparatus comprising:

(A) at least one interruptably operational sewing head having a vertically reciprocatable sewing needle for making stitchline components of said stitching-pattern;

(B) a horizontally extending tabletop peripherally surrounding said sewing needle and extending laterally along an x-axis and longitudinally along a y-axis perpendicularly intersecting said x-axis;

(C) a carriage means attached to the tabletop and located beyond the periphery thereof, said carriage means being movable independently both parallel to the x-axis and y-axis; and (D) gripper means overlying the tabletop and being attached to said carriage means whereby said gripper means is co-movable with the carriage means and both parallel to the x-axis and to the y-axis, said gripper means also being vertically movable and having an up-station further away from the tabletop and having a down-station closer to the tabletop so as to downwardly compress a layup supported upon said tabletop.

9. The apparatus of claim 8 wherein the gripper means comprises a pair of parallel horizontal arms, each arm carrying an underlying pad for engaging a said tabletop supported layup.

10. The apparatus of claim 9 wherein there are steadying means associated with the sewing head and vertically reciprocatable independent of all permitted movements of the gripper means; wherein there are sewing-command means and reposition-command means that are automatically controllable with digital computer means; and wherein the apparatus further includes means for imparting into the layup stitches having substantially constant lengths throughout said stitching-pattern.

11. The apparatus of claim 10 wherein the sewing head is stationarily attached to and overlies the tabletop; and wherein the tabletop y-axis intersects the vertically reciprocatable needle of said stationary sewing head.

12. Method for making quilting having a predetermined stitching-pattern including at least one cusp therealong and having an overall-area located both within and outside a rectangular primary-area having an x-lateral dimension and a y-longitudinal dimension, said method comprising the following steps:

(A) as the initial step, superimposing upon a horizontal tabletop a resiliently-compressible layup of vertically aligned broad sheets, said tabletop extending laterally along an x-axis and longitudinally along a y-axis, there being attached to and overlying said tabletop and interruptably operational sewing head including a vertically reciprocatable sewing needle; and (B) employing a gripper means that is movable independently in the vertical, the x-lateral, and the y-longitudinal directions according to the following steps:

(Ba) during an earlytime-period, downwardly compressing the layup with said gripper means in flanking relationship to the primary-area and sewing needle, and by said gripper means shifting the layup along the x-axis and the y-axis through primary sewing-command means while continuously operating said sewing head thereby providing within said primary-area a primary-design portion of the predetermined stitching-pattern;

(Bb) after said earlytime-period and before a latertime-period, and through gripper reposition-command means, performing the following sub-steps in order:

(i) moving the gripper means upwardly away from the layup, (ii) translating the gripper means in at least one of the x-lateral and y-longitudinal directions, (iii) moving the gripper means downwardly so as to recompress the layup in a new position, and (iv) with said gripper means, shifting the layup primary-area remotely away from the sewing needle;

(Bc) during a said latertime-period, maintaining said recompressed layup in said new position and flanking the sewing needle, and by said gripper means shifting the layup along the tabletop through sewing-command means while said sewing head is operating thereby providing outside said primary-area another portion of the predetermined stitching-pattern; at least one of said sewing-command means providing non-linear stitchlines terminating at a cusp, some of said stitchlines intersecting remotely from the stitching-pattern cusp.

13. The quilting product manufactured by the processing method of claim 12 whereby said quilting product is characterized as follows:

(A) stitches forming the stitching-pattern cause compression of the layup, each sewn stitch being of substantially the same length including throughout a cusped stitchline;

(B) the quilting extends generally along a base-plane, except along the stitching-pattern which extends above the base-plane;

(C) the quilting includes a facing sheet extending generally along a face-plane, except along the stitching-pattern which extends as a depression below the face-plane;

(D) the vertical height of the quilting between face-plane and base-plane is substantially constant including also throughout the primary-area and the secondary-area except at said stitchline depressions corresponding to the primary-design and secondary-design protions; and (E) the quilting along the base-plane is wholly devoid of markings corresponding to the stitching-pattern except for the stitchlines actually forming the stitching-pattern.

* * * * *